US006474771B2

(12) United States Patent
Kim

(10) Patent No.: US 6,474,771 B2
(45) Date of Patent: Nov. 5, 2002

(54) PRINTER INK CARTRIDGE MANAGEMENT SYSTEM

(75) Inventor: Yong-geun Kim, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/841,247

(22) Filed: Apr. 25, 2001

(65) Prior Publication Data

US 2001/0028800 A1 Oct. 11, 2001

Related U.S. Application Data

(63) Continuation of application No. 09/299,143, filed on Apr. 26, 1999, now Pat. No. 6,226,025.

(30) Foreign Application Priority Data

Apr. 25, 1998 (KR) ..... 98-14840

(51) Int. Cl.[7] ..... B41J 29/393
(52) U.S. Cl. ..... 347/19
(58) Field of Search ..... 347/19, 14, 228, 347/140

(56) References Cited

U.S. PATENT DOCUMENTS

| | | | | |
|---|---|---|---|---|
| 5,075,724 A | | 12/1991 | Wada et al. | |
| 5,365,312 A | | 11/1994 | Hillmann et al. | |
| 5,699,091 A | | 12/1997 | Bullock et al. | 347/19 |
| 5,788,388 A | * | 8/1998 | Cowger et al. | 347/19 |

FOREIGN PATENT DOCUMENTS

| | | | |
|---|---|---|---|
| EP | 395320 A1 | 10/1990 | |
| EP | 623858 A1 | 11/1994 | |
| EP | 789322 A2 | 8/1997 | |
| JP | 59-124155 | 8/1984 | B41J/29/16 |
| JP | 2-73264 | 3/1990 | G03G/15/00 |
| JP | 3-220572 | 9/1991 | G03G/15/00 |
| JP | 4-371965 | 12/1992 | G03G/15/00 |
| JP | 6-35309 | 2/1994 | G03G/15/08 |
| JP | 8-171329 | 7/1996 | G03G/21/18 |
| JP | 11-223967 | 8/1999 | G03G/15/00 |

OTHER PUBLICATIONS

Communication from European Patent Office dated Oct. 18, 2001.

* cited by examiner

*Primary Examiner*—Lamson Nguyen
(74) *Attorney, Agent, or Firm*—Sughrue Mion, PLLC

(57) ABSTRACT

A developer unit having a memory, and a method of operating an image forming apparatus adopting the same are provided. The developer unit is provided with a developer information module in which various data associated with the management of the developer unit and the developer is stored. Thus, the engine of the image forming apparatus understands the characteristics of the developer by itself by using the developer information module to perform an optimal control suitable for the developer, thereby obtaining a highest printing quality even when the developer is changed. Also, information associated with the developer and the developer unit, e.g. the manufacturing company, recharging company, shelf life, etc. of the developer and the developer unit, can be efficiently managed. Furthermore, the use of inferior goods such as imitations or counterfeits can be prevented.

19 Claims, 10 Drawing Sheets

FIG. 7

| | |
|---|---|
| MANAGEMENT CODE | MANAGEMENT NUMBER |
| | MODEL NAME |
| | BRAND NAME |
| | MANUFACTURER NAME OF DEVELOPER UNIT |
| | MANUFACTURED YEAR OF DEVELOPER UNIT |
| | RECHARGING COMPANY NAME OF DEVELOPER UNIT |
| | RECHARGING FREQUENCY OF DEVELOPER UNIT |
| | SHELF LIFE OF DEVELOPER UNIT |
| | ⋮ |
| PROPERTY CODE | MANAGEMENT NUMBER OF DEVELOPER |
| | INK MANUFACTURER NAME |
| | INK COLOR |
| | INK COLORING TYPE |
| | INK LEVEL |
| | INK CONCENTRATION |
| | INK DENSITY |
| | ⋮ |

PRINTER INK CARTRIDGE MANAGEMENT SYSTEM

This is a continuation of application Ser. No. 09/299,143 filed Apr. 26, 1999 now U.S. Pat. No. 6,226,025, the disclosure of which is incorporated herein by reference.

BACKGROUND OF THE INVENTION

1. Field of the Invention

The present invention relates to an image forming apparatus, and more particularly, to a developer unit provided with a memory for synthetically managing various items associated with the developer such as the management of the developer unit, the use and exchange period of the developer, and the prevention of use of inferior developers, and a method of operating an image forming apparatus using the same.

2. Description of the Related Art

An image forming apparatus reproduces characters or images on a recording medium according to a transmitted character or image data signal. This image forming apparatus generally includes a photoreceptor (e.g., a photoreceptor drum or a photoreceptor belt) for forming a latent electrostatic image, a charging device for charging the photoreceptor, an exposing device for exposing the charged photoreceptor to light to selectively remove the charge of the charged photoreceptor, and forming a latent electrostatic image of a predetermined pattern, a developing device for developing the latent electrostatic image by supplying a developing medium (e.g., a toner or a developing solution) onto the exposed latent electrostatic image, and a transcribing device for transcribing a developed image to a recording medium.

FIG. 1 is a schematic diagram showing the configuration of a general image forming apparatus.

Referring to FIG. 1, the image forming apparatus includes a photoreceptor belt 104, a charge removing device 105, charging devices 106*a* through 106*d*, exposing devices 107, 108, 109, and 110, developing devices 111, 112, 113, and 114, a drying device 115, and a transcribing device 116. Here, the photoreceptor belt 104 is installed to be capable of being circulated by first, second, and third belt rollers 101, 102, and 103. The charge removing device 105 removes the charge existing in the photoreceptor belt 104. The charging devices 106*a* through 106*d* newly charge the photoreceptor belt 104. Each of the exposing devices 107, 108, 109, and 110 has a laser scanning unit (not shown) for irradiating a laser beam to selectively remove the charge existing in an image forming area of the charged photoreceptor belt 104 in an image-shaped pattern in order to form a latent electrostatic image. The developing devices 111, 112, 113, and 114 develop a latent electrostatic image formed on the photoreceptor belt 104 using a developing solution. The drying device 115 dries the developing solution coated on the latent electrostatic image. The transcribing device 116 transcribes an arbitrary developed image formed on the photoreceptor belt 104 to the recording medium 117 such as a recording paper or a film.

Here, the developing device 111 is comprised of a developing roller 111*a* for coating a developing solution on the photoreceptor belt 104, a developing solution supplier 111*b* for supplying the developing solution to the developing roller 111*a*, a cleaning roller 111*c* for removing the developing solution from the rear surface of the developing roller 111*a*, first and second squeegee rollers 111*d* and 111*e* for removing the residual developing solution from the photoreceptor belt 104, first and second blades 111*f* and 111*g* for removing the developing solution from the first and second squeegee rollers 111*d* and 111*e*, and a developing solution collecting vessel 111*h* for collecting the removed developing solution. The drying device is provided with a drying roller 115*h* for drying the developing solution from the photoreceptor belt 104, and heating rollers 115*i* and 115*j*. The transcribing device 116 is comprised of a transcribing roller 116*t* which receives an image transcribed by the photoreceptor belt 104 by rotating in tight contact with the first belt roller 101 having the photoreceptor belt 104 therebetween, and a settle roller 116*p* for settling an image transcribed to the transcribing roller 116*t* on the recording paper 117.

A wet developing device adopted in such an image forming apparatus, particularly, a wet image forming apparatus, includes a developing unit for developing the photoreceptor belt by directly coating a developing solution thereon, and a developing solution supply unit for continuously supplying a developing solution having a predetermined concentration to the developing unit. A solution, in which the concentration of a powder toner is diluted by mixing a liquid carrier in a concentrated ink solution containing the powder toner, is used as the developing solution for the wet developing device. The concentrated ink solution is generally filled in a cartridge-type developer unit. Such a developer unit is loaded on an image forming apparatus and supplies a developing solution to a developing solution supplying unit. The developing solution supplying unit includes an ink storage tank for storing a concentrated ink solution provided to the developer unit, a carrier storage tank for storing the carrier, and a circulating tank for storing the developing solution having a concentrated ink solution and carrier mixed at an appropriate rate to be supplied to the developing unit. An agitator, for constantly maintaining the concentration of a solution by agitating the solution stored in the ink cartridge and the circulating tank to prevent the powder toner in the solution from being settled, may be Installed on each of the ink storage tank and the circulating tank.

As shown in FIG. 2, such an image forming apparatus, i.e., a printer 205, receives printing data from a computer 201 via a communications interface 204 and performs printing. Here, a control circuit portion 208*a* as shown in FIG. 3 controls the supply of a developer in which already-supplied concentrated ink solution and carrier are mixed in an appropriate ratio, and also controls each control unit in the system according to system setting conditions stored in a memory 208*f*. This image forming apparatus keeps determined system setting conditions and process, so that the control circuit portion 208*a* cannot perform smooth control when a different concentrated ink solution or carrier is supplied. As a consequence, the printing quality becomes degraded. Also, when the component and characteristics of ink or carrier are improved to enhance a conventional printing quality, the system setting conditions fixed as described above prevent use of the improved ink or carrier. In FIGS. 2 and 3, reference numeral 202 denotes an application program, reference numeral 203 is a printer driving program, reference numeral 206 is a printer controller board, reference numeral 207 is a manipulation panel, reference numeral 207*b* is a manipulation button, reference numeral 207*w* is a display unit, reference numeral 208*b* denotes an instrument driving/sensing portion, reference numeral 208*c* denotes an instrumental portion, and reference numeral 208*d* denotes a power supply portion.

SUMMARY OF THE INVENTION

To solve the above problem, it is an objective of the present invention to provide a developer unit provided with a memory for synthetically managing various items associated with the developer unit and a developer, and a method of operating an image forming apparatus using the developer unit.

Accordingly, to achieve the above objective, there is provided a developer unit provided with a memory, which is adopted in a developing device of an image forming apparatus and filled with a developer, the unit comprising: a developer information module installed in a predetermined portion of the developer unit for storing various data associated with the management of the developer unit and the developer.

To accomplish the above objective, there is provided a first embodiment of a method of operating an image forming apparatus adopting a developer unit provided with a memory, comprising the steps of: (a) reading developer information from a developer information module and sends the read developer information to a control circuit portion in a printer engine: (b) determining whether a developer unit is valid, by comparing the read developer information with developer information stored in the control circuit portion: and (c) displaying an error message on a display unit if it is determined in step (b) that the developer unit is not valid, and displaying a predetermined information item among several developer information items on the display unit if the developer unit is valid.

To accomplish the above objective, there is provided a second embodiment of method of operating an image forming apparatus adopting a developer unit provided with a memory, comprising the steps of: (a) reading developer information from a developer information module and sends the read developer information to a control circuit portion in a printer engine: (b) determining whether a developer unit is valid, by comparing the read developer information with developer information stored in the control circuit portion; (c) displaying an error message on a display unit if it is determined in step (b) that the developer unit is not valid, and displaying a predetermined information item among several developer information items on the display unit if the developer unit is valid; (d) setting an optimal system control parameter according to information associated with the received developer; and (e) forming an image according to the set system control parameter and the received image information.

According to the present invention, a control circuit unit reads data recorded in a developer information module to determine whether a developer is suitable, so that use of an improper developer can be prevented in advance. When an improved developer is supplied, the setting conditions for various control parameters of a system are changed to obtain the best printing quality.

BRIEF DESCRIPTION OF THE DRAWINGS

The above objective and advantage of the present invention will become more apparent by describing in detail a preferred embodiment thereof with reference to the attached drawings in which:

FIG. 7 is a memory map of a management code and a property code which are stored in a developer information module memory;

DESCRIPTION OF THE PREFERRED EMBODIMENT

Figure 1:
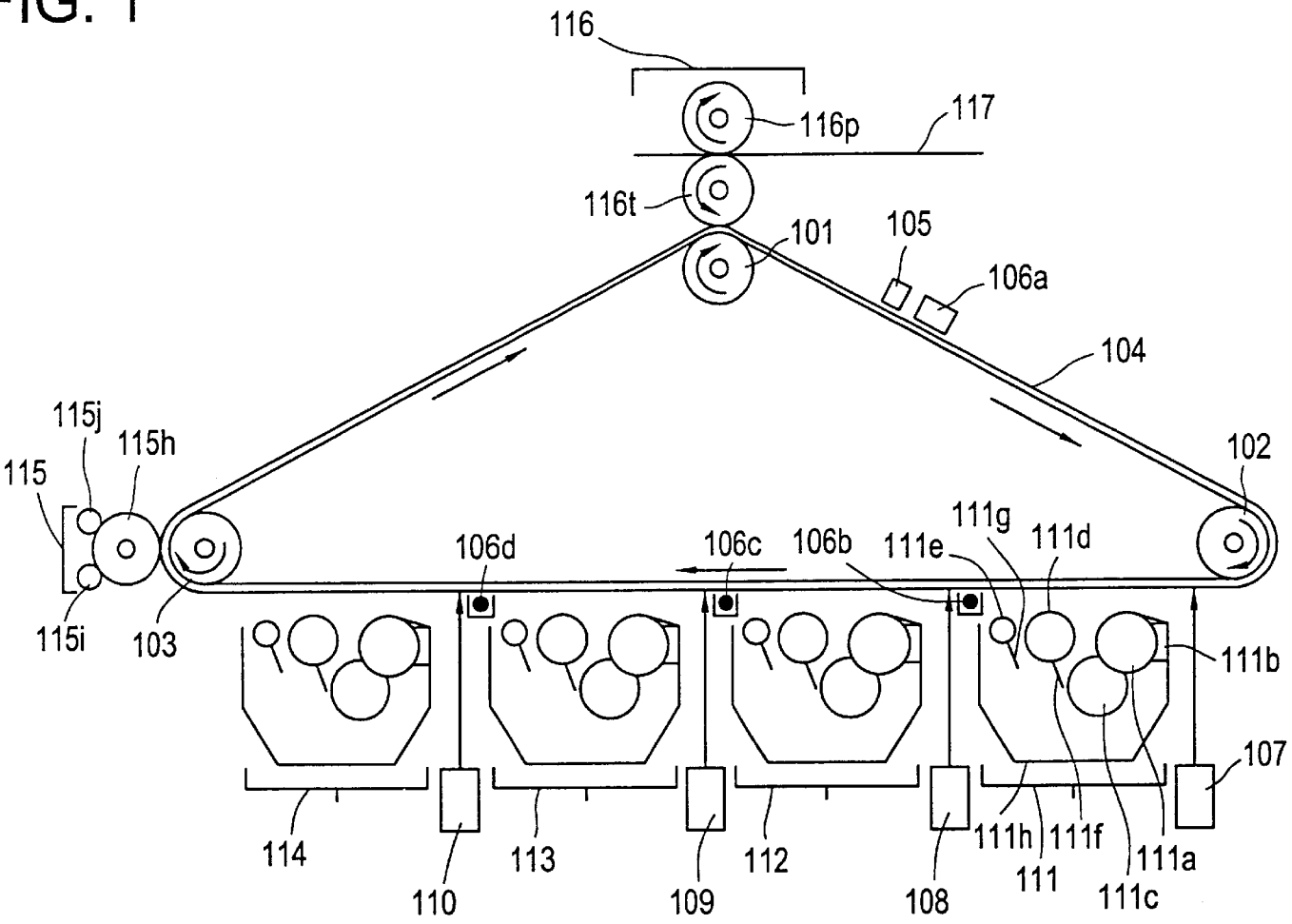
FIG. 1 is a schematic diagram illustrating the configuration of a general image forming apparatus (printer)
Figure 2:
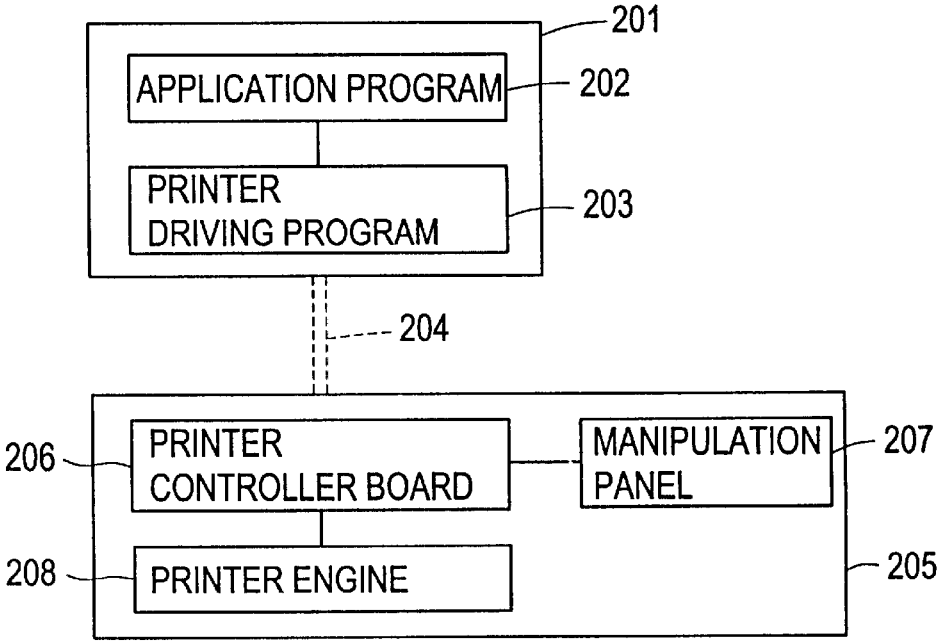
FIG. 2 is a block diagram illustrating the system configuration of a general image forming apparatus (printer) connected to a computer by a communications interface.
Figure 3:
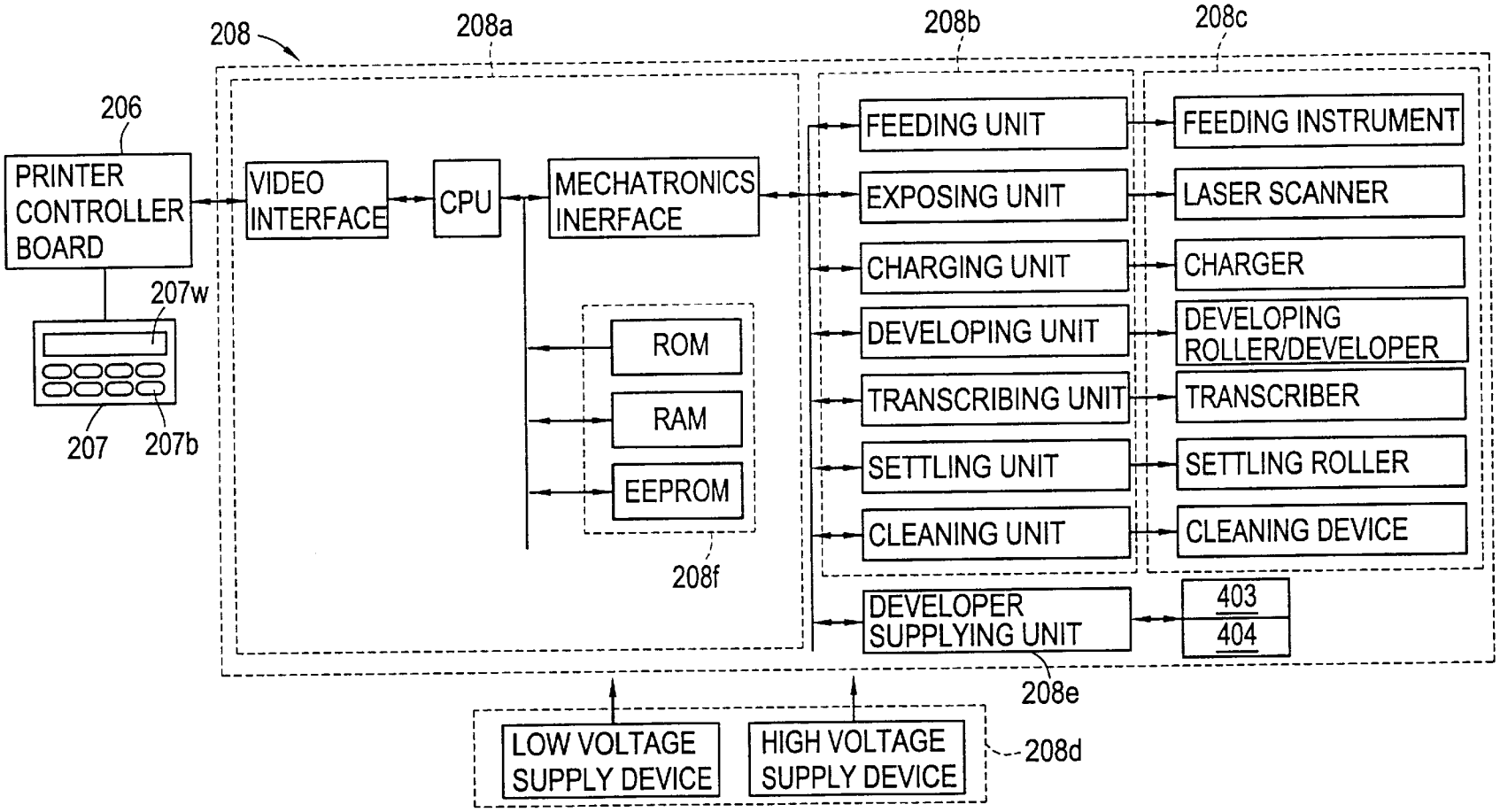
FIG. 3 is a block diagram schematically illustrating the internal system configuration of a printer engine in a general image forming apparatus (printer)
Figure 4:
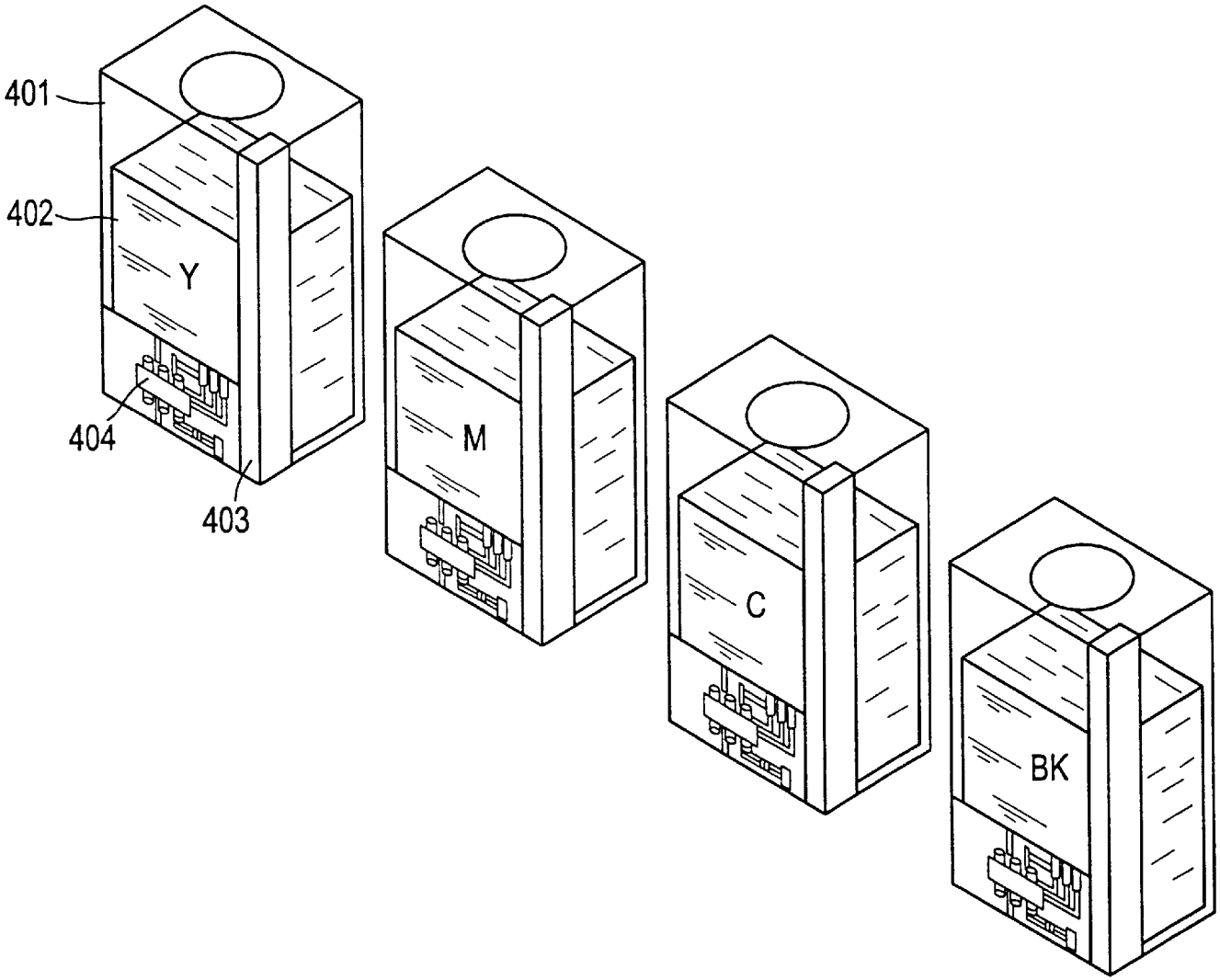
FIG. 4 is a perspective view illustrating separate developer units provided with a memory according to the present invention.
Figure 5:
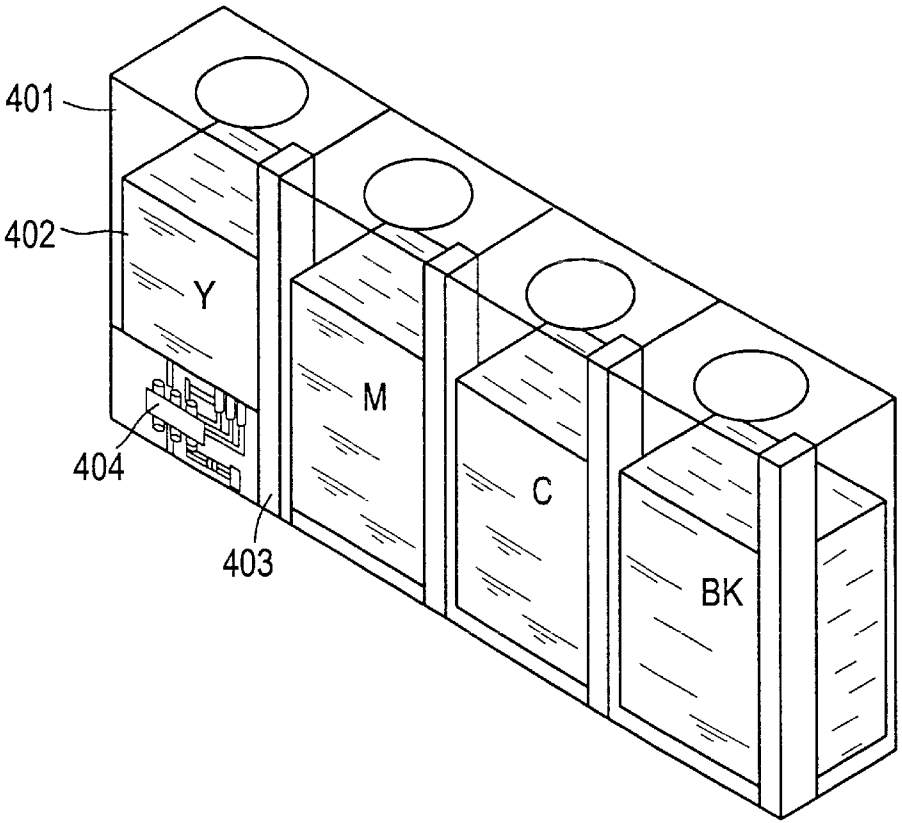
FIG. 5 is a perspective view illustrating an incorporated developer unit provided with a memory according to the present invention.

Referring to FIGS. 4 and 5, a developer unit for an image forming apparatus according to the present invention is adopted in a developing device of an image forming apparatus (printer), and is comprised of a developer case 401, a developer level sensor 403, and a developer information module 404. The developer case 401 is filled with a developer (developing ink) 402 of different colors-yellow (Y), magenta (M), cyan (C), and black (BK). The developer level detector 403 is installed on one corner inside the developer case 401 and detects the level of the developer 402. The developer information module 404 is provided in a predetermined portion of the developer case 401 and stores various data associated with the management of the developer unit and a developer.

Figure 6:
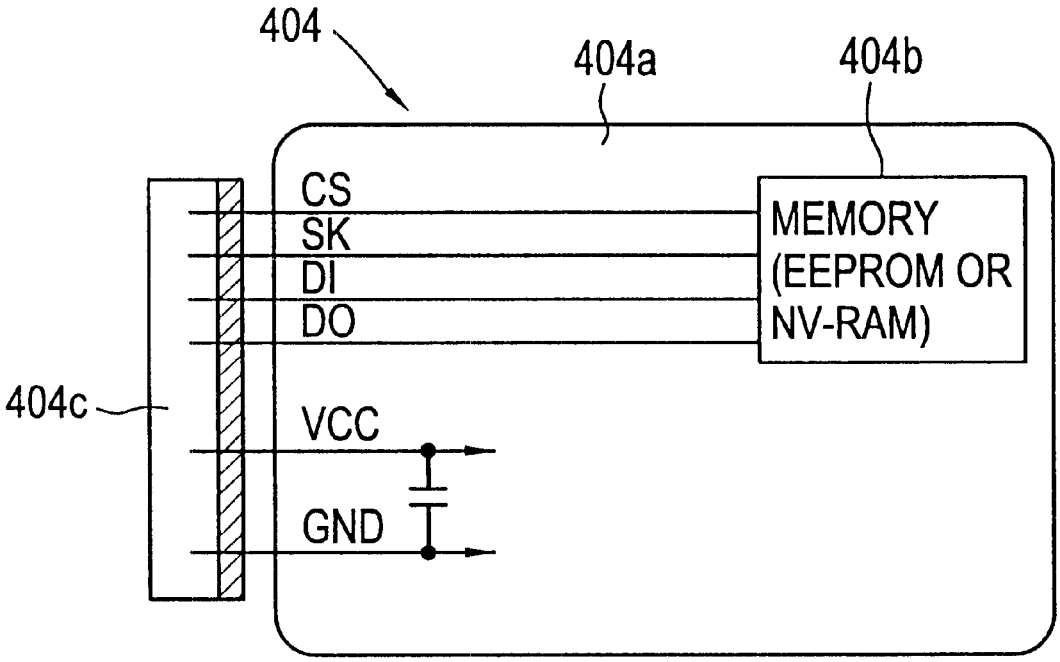
FIG. 6 is a schematic diagram illustrating the configuration of a developer information module in a developer unit provided with a memory according to the present invention.

As shown in FIG. 6, the developer information module 404 is comprised of a substrate 404*a* forming the main body portion of the module, a memory 404*b* installed on a predetermined area of the substrate 404*a* for storing the management information on a developer unit, and an interface connector 404*c* installed on one side of the substrate 404*a* for transmitting a chip selection signal CS, a serial data clock signal SK, a serial data input signal DI, and a serial data output signal DO to the memory 404*b* and connecting a power supply line VCC and a ground line GND to the substrate 404*a*.

Here, the management information on the developer unit is comprised of a management code for providing information for determining whether a developer is suitable for the system of a corresponding image forming apparatus, and a property code for providing information for setting various parameters for the system. As shown in FIG. 7, the management code includes the managing number, model name, brand name, manufacturer name, manufactured year, recharging company name, recharging frequency, shelf life, etc. of a developer unit, and the property code includes the management number of a developer, ink manufacturer name, ink color, ink coloring type, ink level, ink concentration, ink density, etc. Undoubtedly, the developer information module 404 adopted in the incorporated unit of FIG. 5 stores both the management code and the property code of each of the Y, M, C and BK developer units. The developer information module 404 is configured so as to also maintain the data stored in the memory particularly when the developer unit is separated from the image forming apparatus.

An electrically erasable and programmable ROM (EEPROM) capable of erasing the contents stored in a memory or recording new contents, or a nonvolatile-RAM (NV-RAM) capable of preventing loss of stored data even when power is abruptly interrupted, is used as the memory 404*b*.

The developer information module 404 and the developer level detector 403 are electrically connected to the control circuit portion 208*a* of the printer engine 208, and each of them is thus controlled by a CPU in the control circuit portion 208*a*.

An operation method for an image forming apparatus associated with the use of the developer information module in the image forming apparatus (printer) adopting the above-described developer unit according to the present invention will now be described in brief.

Figure 8:
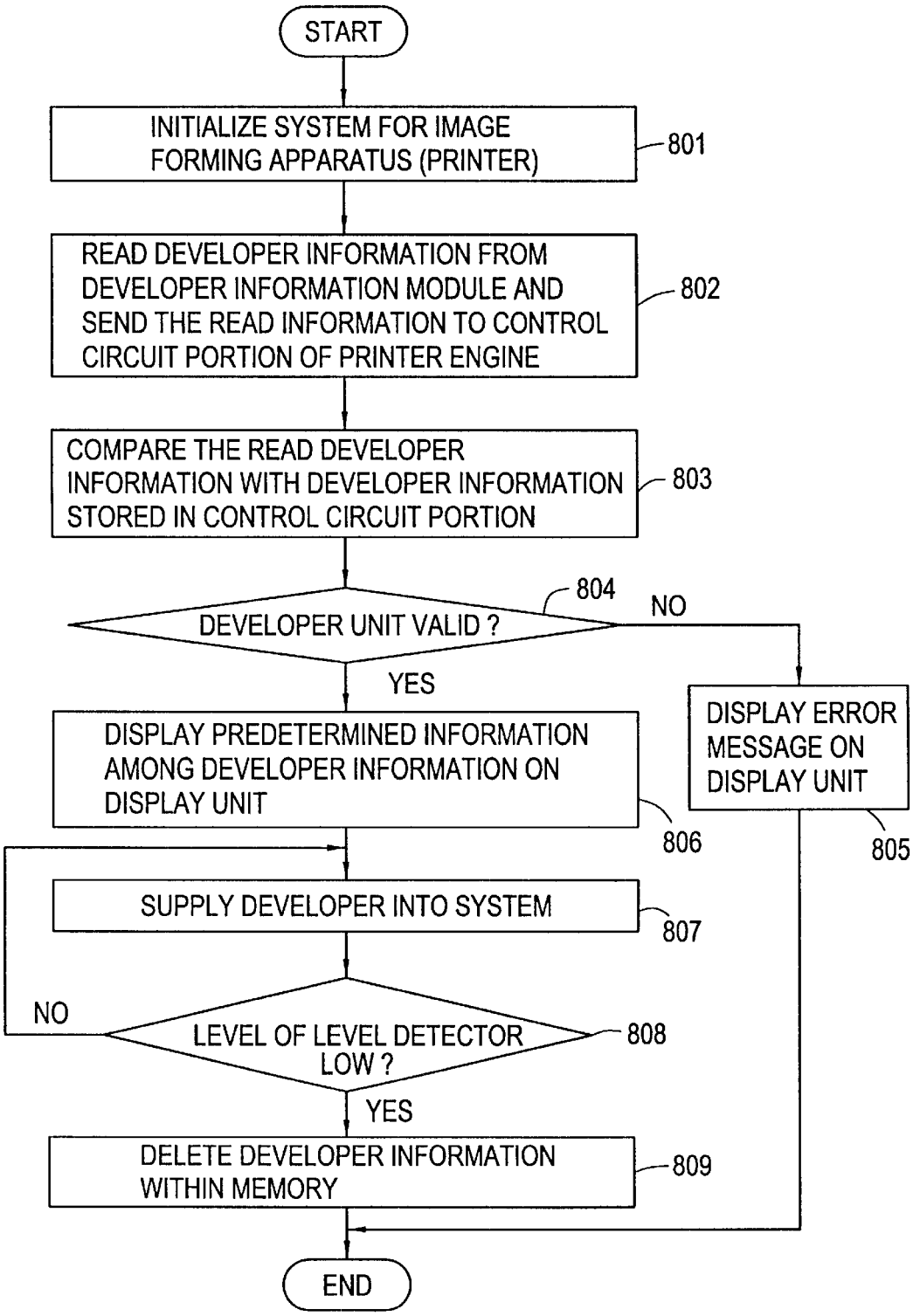
FIG. 8 is a flowchart illustrating a first embodiment of a method of operating an image forming apparatus adopting a developer unit including a memory according to the present invention.

Referring to FIG. 8 illustrating a method of operating an image forming apparatus according to a first embodiment of the present invention, if power is applied to the image forming apparatus (printer), the system is initialized, in step 801. Then, the CPU of the control circuit portion 208*a* in the printer engine 208 reads information (i.e., management code) associated with the developer from the developer information module 404 and sends the read information to the control circuit portion 208*a*, in step 802. The read developer information (i.e., management code) is compared with developer information (i.e., management code) stored in the memory 208*f* of the control circuit portion 208*a*, in step 803. According to the results of the comparison in step 803, It is determined whether the developer unit is valid, in step 804. That is, it is determined whether at least one item among the manufacturer name and brand name of the developer unit is correct. If it is determined in step 804 that the developer unit is not valid, an error message is output and displayed on the display unit 207*w* of the manipulation panel 207, in step 805, and the system is concluded. If it is determined in step 804 that the developer unit is valid, predetermined information among developer information is displayed on the display unit 207*w* of the manipulation panel 207, in step 806. For example, a manufacturer name such as English for Samsung company, Korean for SAMSUNG, and a Samsung company logo, or a brand name "STARDUST" is displayed on the display unit 207*w* in the manipulation panel 207 as shown in FIGS. 10A through 10D. Here, the content to be displayed on the display unit 207*w* is not necessarily limited to the above-described examples, and other information can be displayed in some cases. The display on the display unit 207*w* allows a user to confirm that the developer unit is a regular product provided by a valid supplying company, and prevents use of counterfeit or imitation products, so that reliability in the operation of an image forming apparatus can be attained.

Meanwhile, during the display in the step 806, a concentrated ink solution in the developer unit is supplied to an ink storage tank, in step 807. It is determined whether the level detected by the level detector 403 within the developer case 401 is low, in step 808. If it is determined in step 807 that the level detected by the level detector 403 is not low, the step 807 is again performed by continuously supplying the concentrated ink solution to the ink storage tank. If it is determined in step 807 that the level detected by the level detector 403 is low, the CPU recognizes this fact and deletes at least one name among manufacturer names and a brand name stored in the memory 404*b* of the developer information module 404, in step 809. The step 809 is performed to prevent an irregular developer from being supplied and used in the developer unit according to the present invention and further to prevent the system of the image forming apparatus from breaking down and being damaged.

Figure 9:
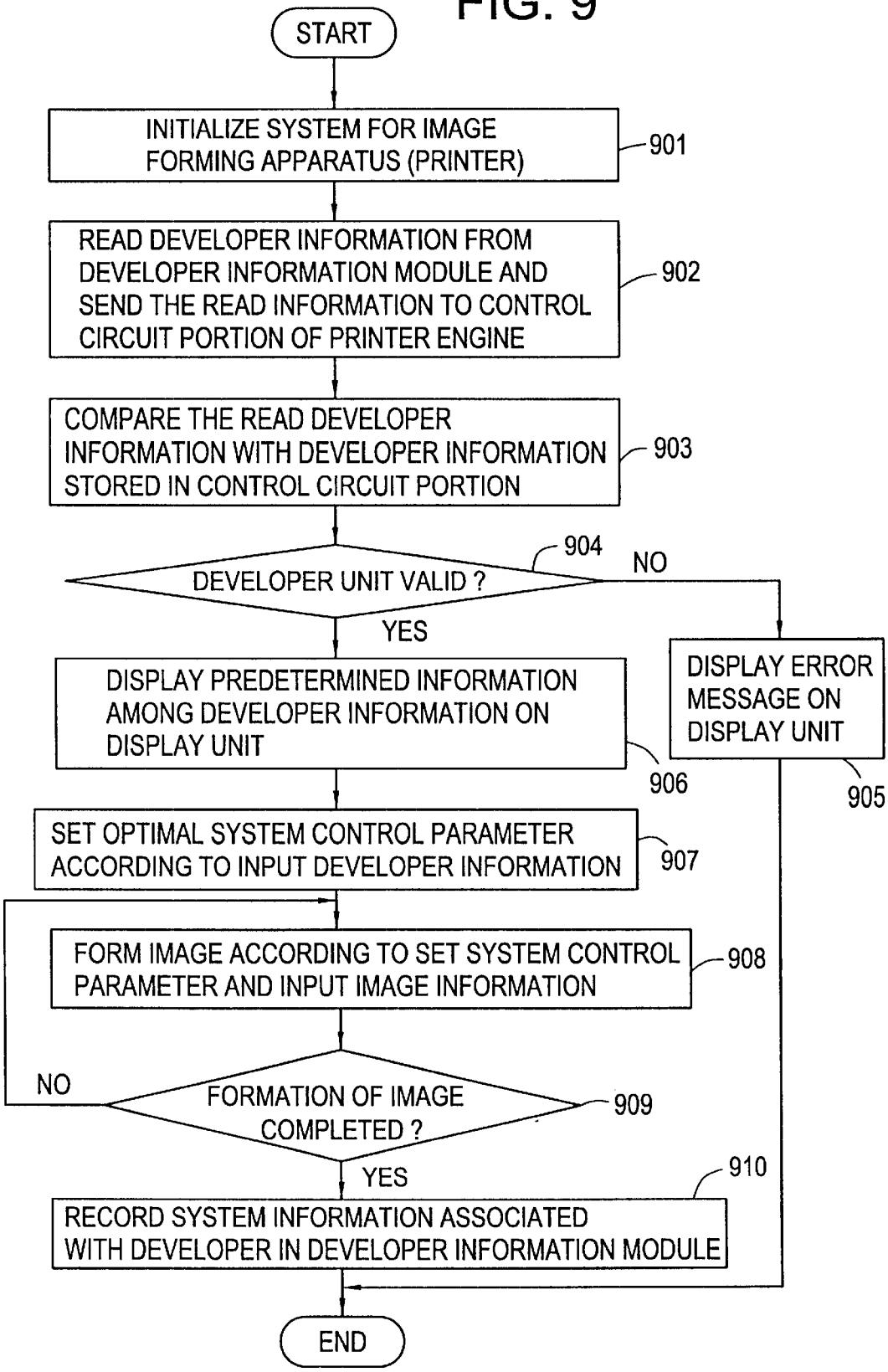
FIG. 9 is a flowchart illustrating a second embodiment of a method of operating an image forming apparatus adopting a developer unit including a memory according to the present invention.
Figure 10A:
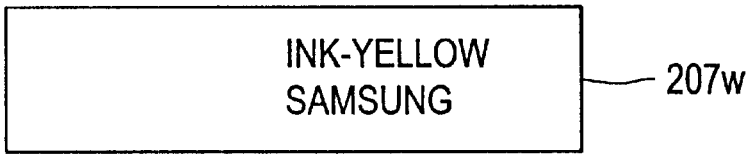
FIGS. 10A through 10D are block diagrams showing examples of a display unit on which the manufacturing company name or brand name of a developer unit is displayed according to a method of operating an image forming apparatus adopting a developer unit including a memory according to the present invention.
Figure 10B:
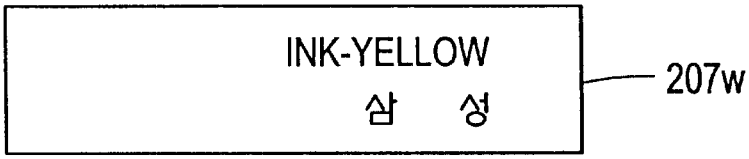
Figure 10C:
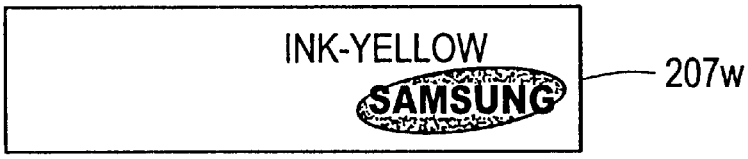
Figure 10D:
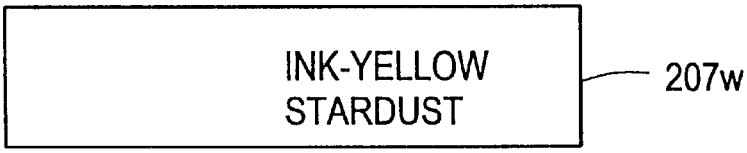

FIG. 9 illustrates a method of operating an image forming apparatus according to a second embodiment of the present invention, which refers to the case in which an improved developer is supplied. When the improved developer is filled in the developer unit, property code information associated with the new developer is stored in the memory 404*b* of the developer information module 404, and a system control parameter is reset by the property code information, thereby enabling printing. This will be described in more detail as follows. Here, the steps 901 through 906 are the same as the steps 801 through 806 in FIG. 8, so they will not be described again. Only the subsequent steps will now be described.

Referring to FIG. 9, if it is determined in step 904 that the developer unit is valid, predetermined information among the developer information is displayed on the display unit 207*w* of the manipulation panel 207 as described in step 806 of FIG. 8. Next, the CPU of the control circuit portion 208*a* changes and sets an optimal system control parameter according to received developer information (i.e., property code), in step 907. Here, both a management code and the property code are included in the received developer information, so the CPU changes and sets a system control parameter on the basis of some information such as ink color, ink concentration, ink density, etc. in the property code. Here, the system control parameter includes a charging voltage, a developing voltage, an exposure output, the temperatures of various rollers (e.g., a drying roller, a transcribing roller, and a settle roller) for forming an image, etc. corresponding to the improved developer.

In this way, when setting of the system control parameter is completed, an image is formed according to the set system control parameter and image information received from a computer, in step 909. If the formation of an image is not completed in step 909, the step 908 is again performed to continuously form an image. If the formation of an image is completed in step 909, system information associated with the developer, e.g., the printing frequency, various ink concentration and density values, etc., are recorded in the developer information module 404, in step 910.

In the above embodiments, both the management code and the property code are stored in the memory 404*b* of the developer information module 404. However, only the management code can be stored to make a determination of whether only the developer unit is valid, or only the property code can be stored to change only the system control parameter.

As described above, the developer unit provided with a memory according to the present invention includes a developer information module which stores a management code and property code capable of synthetically managing various items associated with a developer unit and a developer. Thus, the engine of the image forming apparatus understands the characteristics of the developer by itself to perform an optimal control suitable for the developer, thereby obtaining the highest printing quality even when a developer different from a conventional developer improved to enhance a printing quality is supplied. Also, information associated with the developer and the developer unit, e.g., the manufacturing company, recharging company, shelf life, etc. of the developer and the developer unit, can be efficiently managed. Furthermore, a breakdown or damage to the system due to use of inferior goods such as imitations or counterfeits is prevented, so that reliability in the operation of the system can be attained.

What is claimed is:

1. A printing apparatus being configured to receive at least one ink cartridge for storing and dispensing ink, said at least one ink cartridge having disposed thereon an ink cartridge information module, said ink cartridge information module having stored thereon ink cartridge management information, and an ink level detector, said ink level detector detecting amount of said ink remaining in said at least one ink cartridge, said apparatus comprising:

a control circuit portion configured to communication with said ink cartridge information module and said ink level detector, said control circuit portion being configured to at least one of delete and modify at least a portion of said ink cartridge management information when said ink level detector indicates that said amount of said ink remaining in said at least one ink cartridge is below a predetermined level;

wherein said at least a portion of said ink cartridge management information indicates at least one of authenticity and suitability of said ink cartridge.

2. The printing apparatus according to claim 1, wherein:

said at least a portion of said ink cartridge management information comprises a brand name of at least one of said ink cartridge and said ink.

3. The printing apparatus according to claim 1, wherein:

said at least a portion of said ink cartridge management information further comprises a manufacturer name of at least one of said ink cartridge and said ink.

4. The printing apparatus according to claim 3, wherein:

said at least one ink cartridge is refillable.

5. The printing apparatus according to claim 4, wherein:

said at least a portion of said ink cartridge management information further comprises an information with respect to refilling of said at least one ink cartridge.

6. The printing apparatus according to claim 5, wherein:

said control circuit portion is further configured to compare at least one of said brand name and said manufacturer name with at least one of a previously stored brand name and a previously stored manufacturer name, respectively, and if there is a discrepancy based on said comparison, displaying to a user of said printing apparatus a message indicating said discrepancy.

7. The printing apparatus according to claim 6, wherein:

said control circuit portion is further configured to prevent said printing apparatus from being operated by said user.

8. The printing apparatus according to claim 1, wherein:

said control circuit portion is further configured to re-write a particular portion of said ink cartridge information stored in said ink cartridge information module when a status of said ink cartridge represented by said particular portion changes.

9. The printing apparatus according to claim 8, wherein:

said ink cartridge information module comprises an electrically erasable programmable read only memory (EEPROM).

10. A method of operating an image forming apparatus configured to receive an ink cartridge for storing and dispensing ink, said ink cartridge comprising an ink cartridge information module configured to store therein ink cartridge information regarding at least one of said ink cartridge and said ink, said method comprising:

determining whether an amount of said ink remaining in said ink cartridge is less than a predetermined amount; and at least one of deleting and modifying at least a portion of said information regarding said at least one of said ink cartridge and said ink to indicate that said at least one of said cartridge and said ink is not suitable for use in said image forming apparatus if it is determined that said amount of developer remaining in said developer unit is less than a predetermined amount.

11. The method of operating said printing apparatus in accordance with claim 10, said method further comprising:

reading said ink cartridge information from said ink cartridge information module;

comparing said read ink cartridge information with a previously stored ink cartridge information; and displaying an error message to a user of said printing apparatus if said read ink cartridge information does not match said previously stored ink cartridge information.

12. The method of operating said printing apparatus in accordance with claim 11, further comprising:

preventing said printing apparatus from being operated if said read ink cartridge information does not match said previously stored ink cartridge information.

13. The method of operating said printing apparatus in accordance with claim 10, wherein:

said ink cartridge information comprises a brand name of at least one of said ink cartridge and said ink.

14. The method of operating said printing apparatus in accordance with claim 10, wherein:

said ink cartridge information comprises a manufacturer name of at least one of said ink cartridge and said ink.

15. A computer readable storage medium having stored thereon a set of instructions implementing a method of operating an image forming apparatus configured to receive an ink cartridge for storing and dispensing ink, said ink cartridge comprising an ink cartridge information module configured to store therein ink cartridge information regarding at least one of said ink cartridge and said ink, said set of instructions comprising one or more instructions for:

determining whether an amount of said ink remaining in said ink cartridge is less than predetermined amount; and at least one of deleting and modifying at least a portion of said information regarding said at least one of said ink cartridge and said ink to indicate that said at least one of said cartridge and said ink is not suitable for use in said image forming apparatus if it is determined that said amount of developer remaining in said developer unit is less than a predetermined amount.

16. The computer readable storage medium according to claim 15, wherein said ink cartridge information comprises at least one management information indicating suitability of said ink cartridge for use in said image forming apparatus, said set of instructions further comprising one or more instructions for:

reading said ink cartridge information from said ink cartridge information module;

comparing said read ink cartridge information with a previously stored ink cartridge information; and displaying an error message to a user of said printing apparatus if said read ink cartridge information does not match said previously stored ink cartridge information.

17. The computer readable storage medium according to claim 16, said set of instructions further comprising one or more instructions for:

preventing said printing apparatus from being operated if said read ink cartridge information does not match said previously stored ink cartridge information.

18. The computer readable storage medium according to claim 15, wherein:

said ink cartridge information comprises a brand name of at least one of said ink cartridge and said ink.

19. The computer readable storage medium according to claim 15, wherein:

said ink cartridge information comprises a manufacturer name of at least one of said ink cartridge and said ink.

* * * * *